US006516580B1

(12) United States Patent
Maietta

(10) Patent No.: US 6,516,580 B1
(45) Date of Patent: Feb. 11, 2003

(54) SYNTHETIC STUCCO SYSTEM WITH MOISTURE ABSORPTION CONTROL

(75) Inventor: David D. Maietta, Coto de Caza, CA (US)

(73) Assignee: Multicoat Corporation, Rancho Santa Margarita, CA (US)

( * ) Notice: Subject to any disclaimer, the term of this patent is extended or adjusted under 35 U.S.C. 154(b) by 0 days.

(21) Appl. No.: 09/712,570

(22) Filed: Nov. 13, 2000

(51) Int. Cl.[7] ..... E04B 2/56; E04B 2/84

(52) U.S. Cl. ..... 52/483.1; 52/393; 52/741.41; 52/745.05; 52/745.1; 52/745.13

(58) Field of Search ..... 52/393, 483.1, 52/582.1, 309.7, 515, 446, 741.41, 745.05, 745.1, 745.09, 745.13, 741.4, 741.3

(56) References Cited

U.S. PATENT DOCUMENTS

| | | | | |
|---|---|---|---|---|
| 757,060 | A | * | 4/1904 | Sharp |
| 1,300,493 | A | * | 4/1919 | Seaton et al. ..... 52/446 X |
| 1,322,278 | A | * | 11/1919 | Armstrong ..... 428/150 |
| 1,691,402 | A | | 11/1928 | Oden |
| 2,078,049 | A | | 4/1937 | Benedict |
| 3,455,077 | A | | 7/1969 | Long |
| 3,859,766 | A | * | 1/1975 | Flotow et al. ..... 52/268 |
| 3,910,000 | A | | 10/1975 | Kelsey |
| 4,115,501 | A | | 9/1978 | Yano |
| 4,525,965 | A | | 7/1985 | Woelfel |
| 4,680,907 | A | | 7/1987 | Williams |
| 4,735,027 | A | * | 4/1988 | Evans et al. ..... 52/410 |
| 4,856,244 | A | | 8/1989 | Clapp |
| 5,129,628 | A | | 7/1992 | Vesper |
| 5,231,811 | A | | 8/1993 | Andrepont et al. |
| 5,552,207 | A | | 9/1996 | Porter et al. |
| 5,596,860 | A | | 1/1997 | Hacker |
| 5,634,307 | A | | 6/1997 | Larriberot et al. |
| 5,637,362 | A | * | 6/1997 | Chase et al. ..... 428/15 |
| 5,732,520 | A | | 3/1998 | Maietta |
| 5,763,043 | A | | 6/1998 | Porter et al. |
| 5,916,392 | A | | 6/1999 | Ghanbari |
| 5,979,131 | A | * | 11/1999 | Remmele et al. ..... 52/309.9 |
| 5,987,835 | A | | 11/1999 | Santarossa |
| 6,176,920 | B1 | * | 1/2001 | Murphy et al. ..... 106/676 |
| 6,314,695 | B1 | * | 11/2001 | Belleau ..... 52/309.17 |

OTHER PUBLICATIONS

Subfloor Panels, National Evaluation Service, Inc/International Code Council (Falls Church, Virginia), vol. NER (No. 405), pp. 1–7, (Dec. 1, 2000).

* cited by examiner

*Primary Examiner*—Carl D. Friedman
*Assistant Examiner*—Brian E. Glessner
(74) *Attorney, Agent, or Firm*—Fulwider Patton Lee & Utecht, LLP

(57) ABSTRACT

A method of including the selection of cementitious fiber wallboard panels coated on the exterior surface by a coating of water based acrylic to control the fluid absorption rate therethrough. Such wallboards are installed on a building frame with the adjacent edges of the panels forming narrow gaps for receipt of suitable caulk to such gaps and applying a high build flexible resinous latex emulsion over the coating and joints and allowing it to cure at a rate dictated by atmospheric conditions and the fluid absorption rate of such coating and tape.

16 Claims, 3 Drawing Sheets

SYNTHETIC STUCCO SYSTEM WITH MOISTURE ABSORPTION CONTROL

BACKGROUND OF THE INVENTION

1. Field of the Invention

The present invention relates to synthetic stucco facings for buildings and more particularly to synthetic stucco facings applied to cementitious wallboards coated with flexible resin.

2. Description of the Prior Art

Food and shelter have always been the two most primal needs of mankind and both have undergone a great deal of change since the dawn of our species. Shelter in particular has come a long way from the spelunking days of the caveman and has run the gamut from straw huts to stone temples and practically every other possibility in between. The design and construction of commercial and residential buildings have been the subject of much change especially in the past few decades with the advent of a bewildering array of new materials and methods. One of the most popular and widespread innovations of the century is the use of stucco facing on exterior building walls. A stucco facing consists essentially of a mixture of Portland cement, sand and sometimes small quantities of lime, applied in a plastic state to form a hard covering for exterior walls. The finish texture of stucco is usually rough and is controlled by the particle size of the mixture components.

The popularity of stucco is easily understood when considered in light of its low material, application and maintenance costs, pleasing esthetic qualities, and enhanced thermal insulation. Furthermore, because stucco is applied in a plastic state, it can conform to practically any shape. For this very same reason, stucco can be mixed in almost any color and can be finished in a variety of patterns, such as brick face or stone. Stucco is environmentally safe and easily lends itself to use by homeowners and other non-professionals.

However, stucco suffers from a number of very serious shortcomings. Because stucco is made up almost exclusively of sand and cement, it is porous and quite previous to moisture. When used in areas with high rain fall, stucco can lead to severe structural damage due to fungus and mildew formation when the underlying substrate is plywood or a similar material and can cause damage to interior walls when the underlying substrate is a water permeable material such as dry wall. Such damage remains unseen underneath the stucco facing and can go unchecked for many years, thereby gravely compounding the problem. To combat this shortcoming of conventional stucco, moisture barriers have been employed between the stucco facing and the underlying substrate. Wile their overall performance has been adequate, moisture barriers have typically given rise to their own problems, most significantly that of achieving adequate bonding of the stucco to the underlying substrate through the moisture barrier. Solutions devised to correct this problem have been cumbersome and expensive and typically involved the use of a metal mesh nailed to the substrate through the moisture barrier and holding in place an undercoating of stucco physically bonded to the mesh upon which the final exterior stucco facing is applied. This arrangement is complicated, expensive and time consuming to implement. Driving nails through the moisture barrier compromises the integrity of the barrier and thus defeats its very purpose. The metal mesh is relatively expensive and adds substantially to the weight that the walls must support. In addition, the combination of the mesh and the stucco must have substantial integrity independent of the substrate and the stucco facing is accordingly required to be fairly thick, further driving up weight and cost.

Because layers of stucco are water permeable, they seal against permeation of water to serve in preventing entry of water to be trapped against the underlying substrate and providing for free drainage of any such water that might enter from, for instance, imperfect seals at the peripheral edges of outside wallboard panels. It is obviously preferable to allow water to drain freely and thus special precautions must be taken along openings in the wall such as doors and windows to ensure that water is not absorbed by the wall panels before it has a chance to drain out. Such precautions usually include additional water barriers or flashing, all of which add to the cost and the complexity of the finished structure and thereby detract from the simplicity that is one of the most attractive attributes of stucco. Failure to properly address these shortcomings can result in serious problems for the unsuspecting homeowner, such as wood rot and interior leaks, in as little as two or three years after installation. For these very same reasons, stucco is obviously not well suited to use as roofing material, thereby significantly limiting its potential uses.

Stucco is also a very stiff covering and offers only mediocre impact resistance. Abrasion resistance is also quite poor and stucco covering can be scraped off by almost any hand wielded implement. Rigidity is an especially undesirable characteristic when combined with moisture permeability and, for this reason, stucco has a limited life span when exposed to repeated freeze/thaw cycles because the water absorbed expands and contracts as it freezes and thaws and thus creates internal fractures in the stucco facing that grow and allow even more water to infiltrate through to the underlying substrate. Stucco is therefore also not well suited for use in areas subject to freezing temperatures. Although this problem can be combated, it usually entails applying water sealing agents to the outer surface of the stucco finish. This is a costly approach that is not guaranteed to work because all exposed stucco must be fully saturated and because the sealing agents are usually susceptible to UV light, salt spray and chemicals. Such an approach is also likely to alter the color of the stucco, which is certainly a very undesirable side effect.

The rigidity of stucco also compromises its ability to maintain an attractive exterior surface with the passage of time. It is well known that wall panels tend to shift during the life of the building due to settling and seasonal variations in temperature and the joints between the panels must therefore accommodate these movements. The traditional solution to this problem is to fill the joint with a caulking compound. However, both hard and soft curing caulking compounds tend to shrink or expand under these circumstances and cannot be depended upon to maintain the water tight seal they were intended to form. In addition, both types of caulk give rise to irregularities on the outer surface of the stucco coat around the joint areas such as cusps or depressions that significantly and permanently alter the outward appearance of the stucco finish. Another well known problem is the formation upon curing of a discontinuity in appearance of the stucco coat across the face of the finished wall. This problem exhibits itself both across the face of individual wallboard panels and at the joint between juxtaposed panels.

One solution proposed entails applying a tape over the caulked joints, thus providing a flat surface that is more likely to accommodate the movements of the underlying wall panels and not disturb the overlying materials. Such tapes, however, require a bedding layer in order to adhere to the two adjoining panels, and can sometimes themselves create unsightly bulges on the outer surface of the stucco coat. In addition, joint sealing tapes are typically water proof and do not absorb water from the stucco mix, leading to the surface deformation problems described above.

Stucco is, nevertheless, a very popular construction material and various solutions have been posited for dealing with its shortcomings. It has been proposed, for example, that the wall panels be impregnated with a layer of epoxy upon which a layer of sand can be applied, thereby forming a water resistant layer that offers excellent bonding properties with the stucco mix. While certainly workable, this approach does not eliminate the need for additional coats between the stucco and the underlying substrate and thus is not a cost effective approach. In addition, the sand must be applied while the epoxy is still semi-fluid and therefore is likely to require professionally trained laborers utilizing professional and expensive equipment. Last but not least, applying sand to a wall is always a messy proposition that necessitates special precautions and/or costly cleanups.

Another approach calls for the application of an insulation layer upon the wall, followed by a vapor barrier applied as water-based liquid latex or paste, then covered by two coats of stucco. Various types of reinforcing meshes and bonding adhesives are also suggested as cures for any practical shortcomings this particular invention may exhibit. Although the use of a synthetic stucco mix comprising an acrylic based latex polymer is enumerated, the total number of layers for the finished wall has now increased to four with a corresponding increase in cost and complexity. While this approach is probably very successful for fluid storage structures for which it is intended, it is certainly not the simple, elegant, cost effective solution desperately needed by homeowners and real estate developers alike.

Yet another proposed solution separates the exterior coating from the underlying wall panels in the vicinity of the panel joints, thereby theoretically insulating the exterior covering from the underlying joint movements and the displacement of the caulking compound filing the joint. This is a partial solution because it only addresses the problem of joint displacement and the attendant marring of the exterior surface. This approach also overlooks the fact that as long as the stucco layer is bonded to wall panels that move, the stucco layer will be forced to move as well, often resulting in partial separation from the underlying substrate since it is not allowed to float above unaffected by the movements of the wall panels. For this reason, this approach is likely to have very limited application restricted solely to structures where wall panels do not move appreciably, and such structures are few indeed. Furthermore, this approach does not eliminate the need for installing water resistant layers but, rather, adds at least one additional layer that is installed along the panel joints to separate the stucco layer from the panel edges.

The assignee of the rights in the instant application introduced a composite wallboard construction having the adjoining edges taped to control the rate of cure of a synthetic stucco applied thereto. This construction is shown in my U.S. Pat. No. 5,732,250. While satisfying a long felt commercial need, this construction suffers the shortcoming that commercial grade wallboards typically absorb moisture at different rates across the surfaces thereof. This causes the stucco applied to, in some instances, cure at different rates across the surface thus resulting in an uneven finished surface.

New housing is being erected throughout the civilized world at an accelerating rate and the level of comfort and durability demanded of such structures is increasing as well. What is urgently needed is an attractive exterior wall which exhibits an even finished appearance but is low cost, adaptable and easy to install while offering much improved moisture protection, impact and abrasion resistance, and resistance to freeze/thaw cycles.

SUMMARY OF THE INVENTION

The method of the present invention is characterized by an exterior synthetic stucco wall construction wherein commercial grade cementitious wallboard panels are selected having an exterior surface covered by a coating which will provide for uniform moisture absorption across the face of such panels and selecting an elastomeric adhesive joint sealing tape for covering gaps formed between adjacent edges of such panels to cooperate in affording overall uniform moisture absorption. Synthetic stucco mix of the type including components of water based resinous latex, coalescing agents, dispersants, defoamers, surfactants and inert fillers is mixed with such components in a ratio to, when applied over such coating and tape, cure and provide a strong bond and exhibit flexibility, water resistance, and substantially uniform exterior coloration across the face of the exterior wall formed by the wallboard panels.

The present invention takes advantage of commercial grade cementitious fiber wallboard panels that are free of asbestos and other inorganic fibers and are environmentally safe to install. The cementitious wallboard panels provide an excellent bonding surface for a uniform acrylic or other synthetic resin coating to provide for uniform absorption from a synthetic stucco mix applied thereover. The panels are installed on wood or metal frame structures with small gaps between the panels. Polyurethane caulk is applied to the gaps between the panels and allowed to cure. Polyurethane caulk remains flexible once it has cured and usually maintains, although not always, its integrity when the wall panels settle or move due to seasonal temperature variations. The elastomeric adhesive joint sealing tape applied over adjoining edges of panels to cover all gaps and to comers has a thin fabric backing that allows minimal amounts of water to be absorbed from the synthetic stucco layer. The elastomeric adhesive on the tape provides a water tight seal along the joints and ensures that any water that permeates the synthetic stucco layer does not infiltrate through the joints to the interior walls of the building. The tape and coating cooperate to provide for a relatively uniform rate of moisture absorption to thus provide for a substantially uniform cure rate for such stucco across the entire face of the wall formed by the wallboard panels.

The synthetic stucco mixture may be applied by trowel or sprayer on the outer surface of the coated panels and over the tape on the joints and can be finished to the desired texture. Such stucco mixture is of a generally uniform thickness and porosity and the coating and tape of comparable absorption rates so that the curing rate across the surface of the wall formed by the combined panels is controlled to be substantially uniform to thus prevent formation of irregularities in the surface of such stucco as might otherwise occur from uneven curing. The fabric backing of the sealing tape provides a flat porous surface that the overlying synthetic stucco coat bonds and adheres to regardless of any movement or settling of the underlying panels and caulk. Because the tape has a very low profile, the synthetic stucco coating does not 'ride up' and bulge over the tape even when the coating is very thin and there is no need for applying the traditional bedding coat to disguise the presence of the tape. The synthetic stucco mixture cures as water evaporates from it or is absorbed through the coating on the underlying wall panels and the fabric backing of the adhesive tape. Because the fabric backing of the tape also absorbs water from the synthetic stucco mixture, it cooperates with the coating to prevent non-uniform appearance in the outer surface of the synthetic stucco coat in the vicinity of the panel joints due to unequal water absorption.

The synthetic stucco mixture is preferably an acrylic or other compatible water based resinous latex emulsion containing calcium carbonate or other non-reactive sand. The mixture bonds extremely well to the coating on the wall panels and to the fabric backing of the elastomeric sealing tape. In addition, the latex in the mixture provides an effective barrier against water infiltration and remains flexible when cured to thus offer significantly improved abrasion and impact resistance while being highly resistant to damage from repeated freeze/thaw cycles and unaffected by most chemicals. The present invention therefore provides a method for producing a synthetic stucco finished exterior wall with a single coat application of synthetic stucco mix and extends the range of projects that can now employ a stucco-like material and reap its traditional advantages as well as the new benefits disclosed herein.

Furthermore, the latex employed is water based and the mixture is environmentally safe to apply. In addition, latex emulsions are compatible with a wide range of coloring agents and the synthetic stucco finish can therefore be manufactured and applied in virtually any color desired.

The wall apparatus of the present invention is characterized by wallboard panels, each covered by a coating, having a predetermined moisture absorption characteristic to cooperate with a joint sealing tape having a selected moisture absorption characteristic so a water based synthetic stucco applied evenly across the face thereof will cure at the same rate throughout the wall area to afford a uniform exterior surface.

Other features and advantages of the invention will become apparent from the following detailed description, taken in conjunction with the accompanying drawings, which illustrate, by way of example, the features of the invention.

DETAILED DESCRIPTION OF THE PREFERRED EMBODIMENT

Stucco facing is one of the most popular methods of finishing the exterior walls of residential and commercial structures due to the ease and flexibility of application, relatively low cost and wide range of possible finishes. However, conventional stucco facings may be water permeable and typically require expensive moisture barriers. Because conventional stucco is brittle, it is very susceptible to repeated freeze/thaw cycles and offers little resistance to impact and abrasion. In addition, conventional stucco does not bond well to moisture barrier materials and requires additional special bonding layers that are time, material and labor intensive. In my prior work I developed a synthetic stucco construction and method of application involving the erection of cementitious fiber wallboard panels and the application of a synthetic stucco mix directly thereto. This method is described in U.S. Pat. No. 5,732,250, assigned to the assignee of the rights in the instant application. While commercially successful, that structure suffers the shortcoming that the finished exterior surface can produce a non-uniform appearance. The method and structure of the present invention overcomes this shortcoming.

Figure 1:
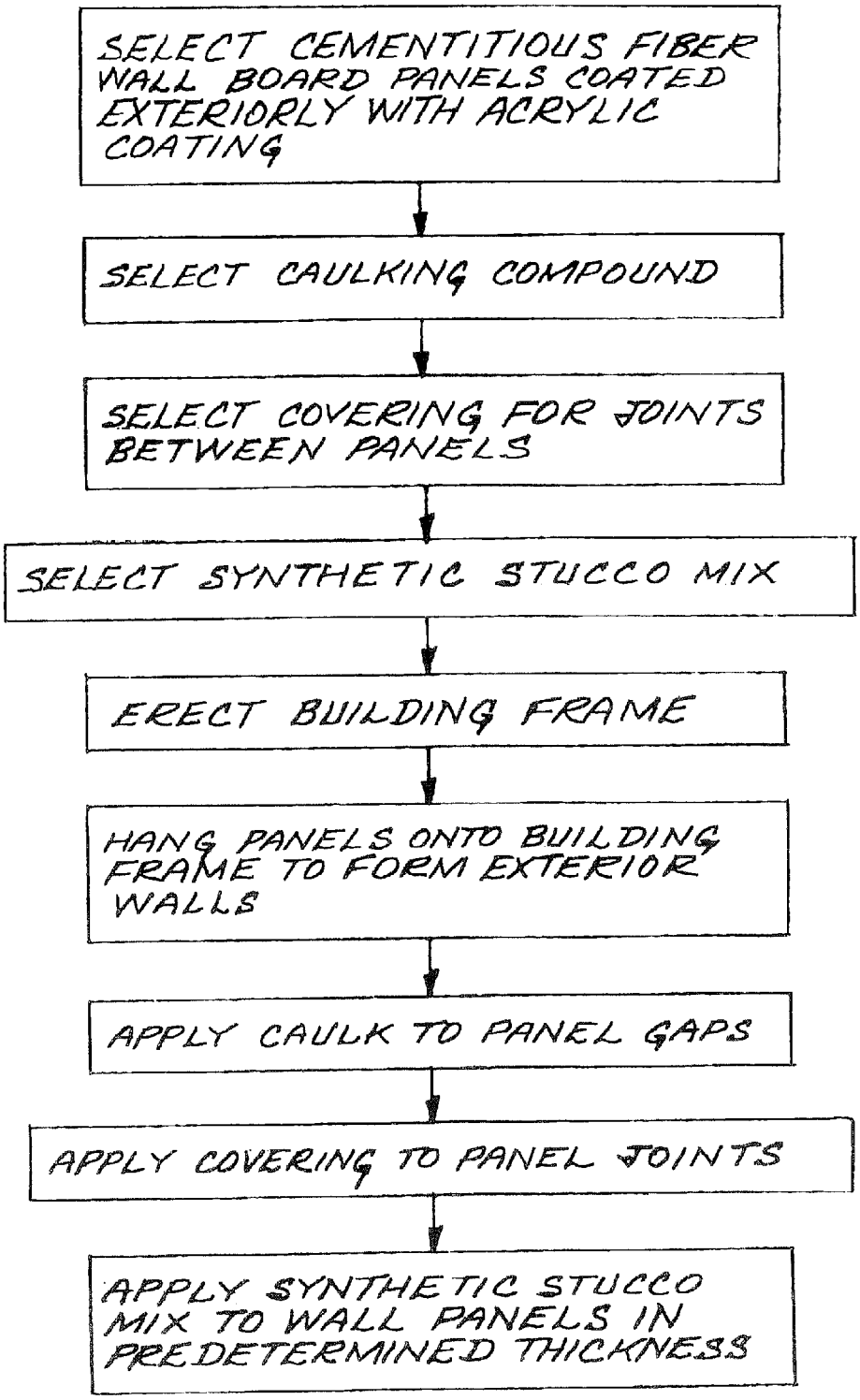
FIG. 1 is a block diagram depicting one embodiment of the method of the present invention.
Figure 2:
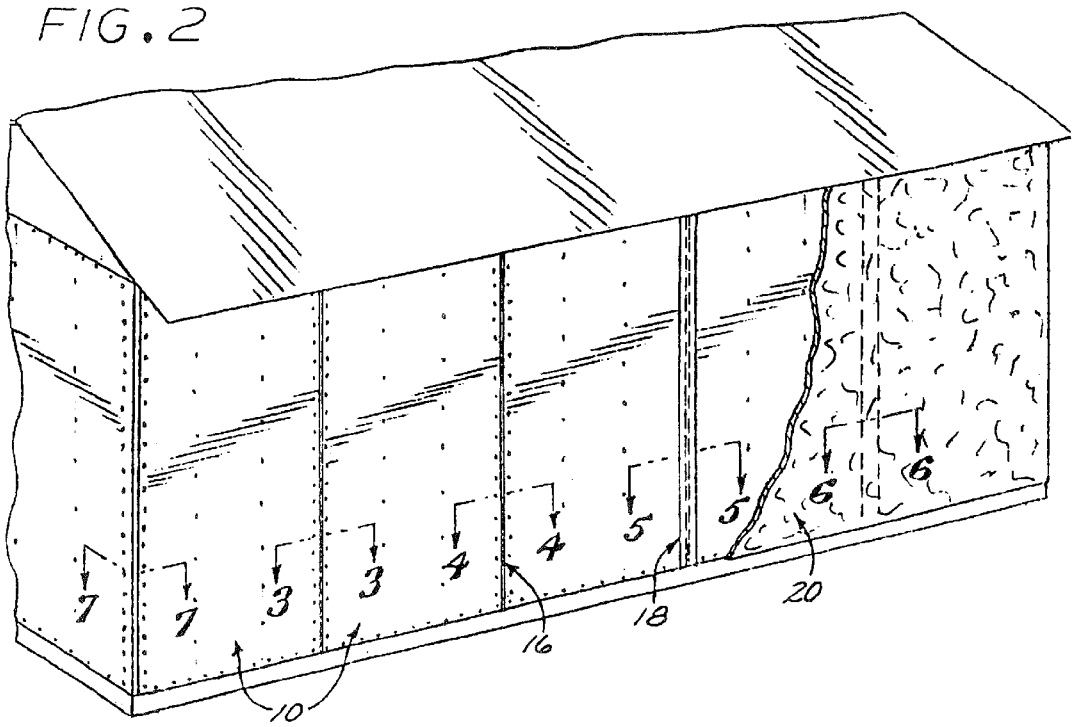
FIG. 2 is a perspective view of a partially broken away building with a stucco wall embodying the present invention.

Referring to FIGS. 1 and 2, the present invention entails, generally, selecting cementitious fiber wallboard panels 10 of conventional construction and covering the exterior with a moisture control coating 11 having a known moisture absorption characteristic and forming walls by installing such panels 10 onto a building frame 12. Small gaps may exist between the edges of adjacent panels. Polyurethane caulking compound 16 may be applied in the gaps. A low profile fabric backed joint sealing tape 18 of a selected moisture absorption characteristic selected to complement the coating 11 is applied over adjoining edges of the panels 10 to cover the caulking gaps therebetween. A flexible resinous latex emulsion is applied to the exterior surface of the coating 11 and the tape 18 and finished to the desired texture to form an exterior synthetic stucco facing 20. The coating 11 and tape 18 are selected to cooperate in providing complementary moisture absorption characteristics to thus provide a substantially uniform rate of cure across the panels and tape joints making up the stucco wall.

Referring to FIG. 2, the initial step consists of erecting a building frame 12 by carpenters or other skilled personnel. The frame may be of wood or metal or any combination thereof. The frame design and erection as well as the materials employed must be in accordance with applicable codes and standards.

Following erection of the frame 12, the panels 10 must be selected. I have discovered that by selecting panels 10 covered with the coating 11, which present a predetermined barrier to moisture absorption into the bodies of the respective panels 10, the cure rate can be controlled at a uniform rate across the exterior face of the panel structure to thus provide a uniform exterior appearance. The panels 10 may be of a commercial grade lightweight, non-combustible, cementitious fiber wallboards that contain no asbestos or other inorganic fibers. Such panels should be resistant to termites, chemicals and repeated freeze/thaw cycles and preferably offer little or no flame spread or smoke generation. Commercially available products such as wallboard sold under the trade name MaxiPanel by MaxiTile, Inc., 849 S. Sandhill Avenue, Carson, Calif., 90746 or wallboard available from James Hardie Building Products, 26300 La Alameda, Mission Viejo, Calif., are ideal for use in the present invention as the panels 10. Such panels may be coated with a thin coating 11 during the manufacturing process. The coating 11 may be a water based resin based coating such as an acrylic sealer. In the preferred embodiment, I utilize a sealer available from Multicoat Corporation, Rancho Santa Margarita, Calif. under the trade designation ARCATHANE, diluted with, for example, one to three parts water. In one embodiment, I use AC-261 available from Rohm and Haas but any water base acrylic or other water based resin which exhibits the same control over the rate of absorption is acceptable. Typically, I dilute the sealer with one or more parts water. The diluted sealer is then applied to the face of panels 10 as a continuous process to provide a relatively uniform covering to a thickness afforded by approximately one gallon of such diluted sealer to 400 square feet of panel. In practice, the rate at which such diluted sealer is applied will be determined by the degree to which the sealant has been diluted. I have found that for a 1:1 diluted sealant, an application rate of one gallon to between 200 and 400 square feet of wallboard panel produces a satisfactory moisture absorption rate.

While, I prefer to select panels which have been coated at the time of manufacture, it will be appreciated by those skilled in the art that, if desired, the coating 11 could be applied to the wallboard panels at the construction site. It is preferable though to order the panels specially coated by the supplier who can take advantage of the economics of employing a continuous coating process during manufacture.

Figure 3:
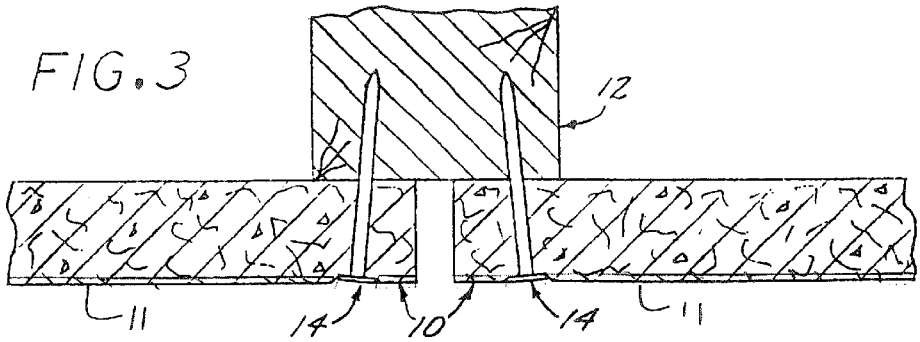
FIG. 3 is a cross sectional view in enlarged scale taken along line 3—3 of FIG. 2.

Referring to FIGS. 2 and 3, the coated panels 10 are transported to the construction site and may be hung from the frame 12 to form exterior walls with the coating 11 facing outwardly. The panels 10 can also be installed over existing walls formed of plywood, drywall or any other substrate. The panels 10 must be installed according to the manufacturer's instructions and applicable building codes using the required or recommended types of fasteners 14 and should be installed a minimum of ⅛" apart. It is preferred that the fasteners 14 be installed flush with the surface of the coating covering the panels 10 to allow better coverage by the synthetic stucco mix 20 and thus offer better resistance to water infiltration. Expansion joints should be provided approximately every 16 feet for walls with no openings, such as doors or windows.

Figure 7:
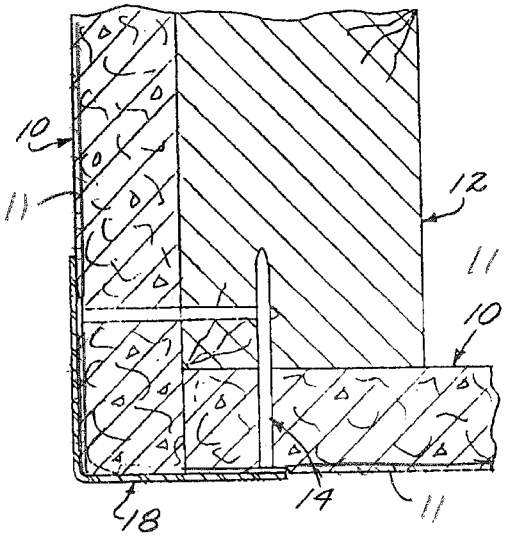
FIG. 7 is a cross sectional view in enlarged scale taken along line 7—7 of FIG. 2.
Figure 8:
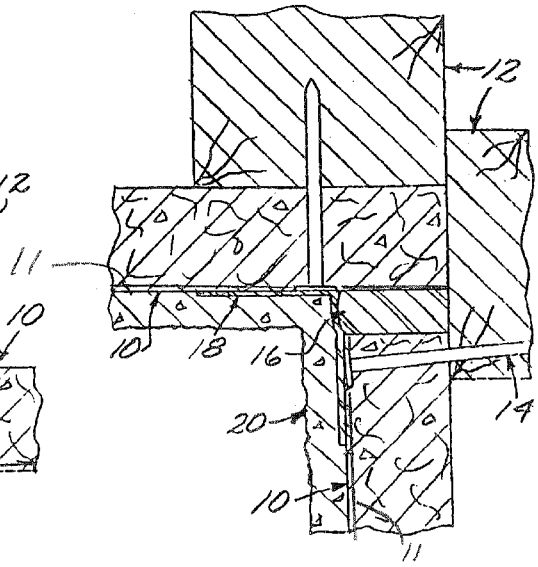
FIG. 8 is a cross sectional view in enlarged scale of an internal corner of the building shown in FIG. 2.

Referring to FIGS. 7 and 8, lateral comers formed by two adjacent panels 10 must also have a minimum gap space of ⅛" between the two panels 10. However, external comers that 40 are formed by two adjacent panels 10 must offer continuously flush surfaces for application of the latex emulsion 20 with no gap space between the panels 10.

Figure 4:
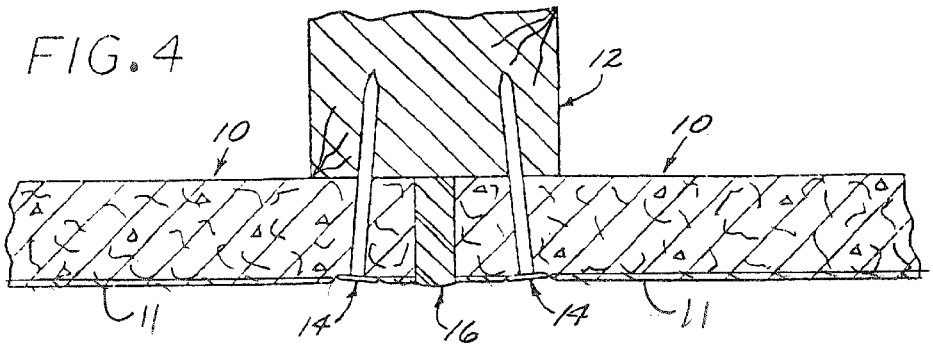
FIG. 4 is a cross sectional view in enlarged scale taken along line 4—4 of FIG. 2.

Referring to FIG. 4, after the panels 10 have been installed on the frame 12, a caulking compound 16 is applied in the joints between the panels 10. The purpose of the caulking compound 16 is to seal the panel joints. The caulking compound must be installed according to the manufacturer's specifications and directions and must be allowed to cure fully prior to proceeding with the next step. The caulk 16 can be either slow or fast setting and can be any standard, commercially available polyurethane caulk, such as PR 255 Pro-Series available from Ohio Sealants in Mentor, Ohio. The use of polyurethane caulk is preferable because such caulk remains flexible even when fully cured and usually accommodates movement of the panels 10.

Figure 5:
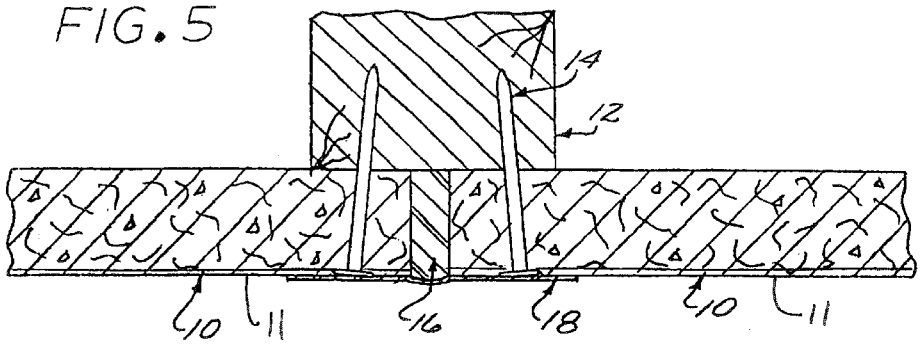
FIG. 5 is a cross sectional view in enlarged scale taken along line 5—5 of FIG. 2.

Referring to FIG. 5, the next step consists of selecting a self adhering joint sealing tape with specific water absorption and other characteristics as described below. The tape 18 is applied over the joints formed by adjacent edges of panels 10 to cover the cured caulk 16 therein. The adhesive tape is preferably composed of an elastomeric butyl rubber or other compatible synthetic rubber self adhesive with a fabric backing such as of wood fibers and spun polyester and has a very low profile of between 10 and 26 mils. Synthetic rubber elastomers such as butyl rubber offer aggressive, water tight bonds and when used together with polyurethane caulk act to prevent water infiltration through the joints, a chronic problem with conventional stucco finish systems.

The use of a joint sealing tape in addition to a caulking compound is highly desirable for a number of reasons. Chief among these is the fact that wall panels tend to shift during the life of the building due to settling and seasonal variations in temperature and the joints between the panels must accommodate these movements. Soft curing compounds such as polyurethane caulk tend to bulge when squeezed together and stretch out when pulled apart. Under either circumstance, the caulk may give to irregularities such as cusps or depressions on the outer surface of a stucco coat around the joint areas that significantly and permanently alter the outward appearance of the stucco finish. Furthermore, because caulk is waterproof, it does not absorb water from the overlying stucco mix so, left uncovered, would produce a non-uniform appearance in the joint areas between the coated panels. Applying a tape over the joints, however, serves to provide a flat surface that is more likely to accommodate the movements of the underlying wall panels and not disturb the overlying materials. A tape will also provide water resistance at the joints, as well as enhance the mechanical strength of the joints and thus help minimize unequal movements of the wall panels 10.

The fabric backing of the adhesive tape also offers a host of advantages over other types of joint sealing tapes. The fabric exhibits high tensile strength and thus offers excellent resistance to ripping and excessive distortion or stretching. The use of a fabric backed adhesive tape therefore adds strength and crack-resistance to the panel joints. In addition, the high tensile strength of the fabric allows it to resist tearing from tools and lie flat during installation.

The permeability of the fabric backing of such tape and of the coating 11 also plays a crucial role during the curing stage of the synthetic stucco mix. The synthetic stucco mix cures as water evaporates through its exposed surface or is absorbed from it by the underlying substrate. A chronic problem encountered with panels is that they absorb at different rates across their surfaces and at the joints. This uneven water absorption leads to unequal curing rates and often results in non-uniform appearance across the outer surface of the stucco finish substantially compromising the esthetic appeal of the stucco finish. This very serious problem is solved by the present invention through the use of the coating 11 and tape 18 to establish an absorption rate from the synthetic stucco mix that is substantially uniform across the entire surface of the structural walls so that the cured stucco wall exhibits an even outer appearance in the areas overlying the panel joints and adjacent panels.

Because the coating 11 is water based resin, such as acrylic, it is permeable and also offers an excellent bonding surface for the synthetic stucco mix. The synthetic stucco mix is applied in a semi liquid or flowable state and permeates the coating 11 and fabric backing of the tape at complementary rates to cure at a substantially uniform rate across the faces of the individual panels and across the taped joints to thus form a homogeneous, strong, highly water resistant bond. The synthetic rubber adhesive ensures a very strong grip onto the coating 11 of panels 10 to thus provide a substantially uniform direct bond between the synthetic stucco coat 20 and coating 11 and the adhesive tape 18 at the panel joints. Because of this very strong, homogeneous bond, the flexible synthetic stucco coat 20 accommodates normal movement of the underlying substrate along the entire wall length resisting cracking, deformation or outright delamination across the faces of the panels and along the joints. The strength and homogeneity of the bond also allows the synthetic stucco coat to impart additional structural strength to the walls it is covering and thereby helps minimize unequal movement of the wall panels 10 and the attendant joint movement problems. Other joint sealing tapes such as paper backed tapes may not offer this advantage because the paper backing is usually coated with a water repellent and cannot be permeated by the fluid stucco mix and therefore the bond formed between the stucco mix and the paper backed tape is inferior in strength and durability while the outer surface of the cured stucco finish may exhibit a non-uniform appearance as mentioned above.

The use of tape joints between panels is known from my earlier work. The attendant problems of non-uniform outer surfaces, discoloration, delamination, joint cracking, and water infiltration is also known. It has now been determined that uniform coating of the panel faces with the water based sealer of the present invention, in combination with the taped-joints, overcomes these problems.

It has been discovered that, for an acrylic or other compatible sealer diluted with water, coating of commercial grade wallboard may be to the thickness afforded by one gallon by W volume to 400 sq. feet of panel and up to a thickness afforded by about one gallon to 200 square feet, with about one gallon per 300 square feet being preferred.

In practice, it will be appreciated by those skilled in the art that the thickness of the tape and coating may be varied depending on the make up of the synthetic stucco mixture as described below. It has been found that a tape thickness between about 10 to 26 mils exhibit the necessary absorption characteristics with about 13 mills being preferable. Mixing stucco batches with a variety of ratios of components as described below may be necessary due to normal variations in raw material supplies. In such cases, test areas prepared from each batch of said raw materials are applied at the desired thickness over the coating and tape at the joints between test panels. The test areas are then allowed to cure and examined for the continuity of the finished surface. Those skilled in the art can then select the synthetic stucco formulation which produces a cured finish surface with a uniform appearance in the surface of the stucco in the area over the tape and the adjacent panel area and can then proceed to duplicate the batch or batches having the ratios of components resulting in a satisfactory finish surface. Thus, the present invention allows those skilled in the art to now produce one coat synthetic stucco walls that retain their uniform outward beauty and their inner structural integrity over time and under adverse conditions. The present invention therefore provides a method for significantly enhancing the esthetic appeal as well as the performance of outer wall synthetic stucco facings.

In practice, the preferred adhesive tape 18 is that sold under the trade name Multicoat Elastomeric Joint Tape available from Multicoat Corporation of Rancho Santa Margarita, Calif. The adhesive tape 18 to be applied over the gaps between coplanar panels 10 is preferably approximately 3" wide to ensure adequate adhesion to the panels and a water tight seal and the adhesive tape 18 applied over corners formed by two adjacent panels 10 is preferably 6" wide.

The next step after erecting the panels 10 and applying the joint sealing tape 18 consists of preparing a synthetic stucco mix that, when applied at the desired thickness to the walls of the building, will cooperate with the coating 11 covering the outer surface of the panels 10 and the exposed fabric backing of the tape 18 to, upon curing, produce a strong, homogeneous, water resistant bond and a uniform exterior surface in the areas overlying the tape and the adjacent panel surfaces. Commercial grade synthetic stucco mixes typically vary in their characteristics from batch to batch and are highly dependent on the properties of the particular components and the ratios in which they have been added to the mixture. For batches of the synthetic stucco mixture of the present invention, the ratio of the various ingredients must be adjusted in a known manner because of normal variations in raw materials to provide the resultant mixture with characteristics such that, when applied over the wall panels and sealing tape and allowed to cure, will form a synthetic stucco coat that is water resistant, durable, flexible and presents a uniform outer appearance from the areas to overlying the sealant tape to the areas overlying the adjacent panels. It has been discovered that by selecting wallboard covered by the moisture control coating of the type described and sealing tape as characterized, the ratio of components in the synthetic stucco mixture can be adjusted by those familiar with mixing synthetic stucco material to provide the desired characteristics of bonding strength, impermeability, flexibility, durability and uniform outer appearance without the need for primer, bond or barrier layers. Those skilled in the art will recognize that in practicing the present invention if the mixture exhibits unwanted characteristics upon the curing of a test batch, the component ratio can be adjusted in a known manner to eliminate the defect and provide the desired results.

The preferred synthetic stucco mix consists of an acrylic or other compatible resinous latex emulsion prepared primarily by combining a water based acrylic or other compatible resinous latex with a calcium carbonate or other inert sand. The sand is applied in various mesh sizes as dictated by the roughness of the final synthetic stucco finish desired. Varying amounts of coalescing agents, dispersants, defoamers and surfactants are added to the latex and sand mixture in proportions understood by those skilled in the art as necessary to account for variations in the raw materials used and to achieve the desired mixture characteristics as described in the disclosure. Bacteria and fungus control agents are also added to the mixture to enhance the resistance of the synthetic stucco finish to such environmental hazards. The resultant mixture is compatible with most coloring agents and the synthetic stucco finish can be manufactured and applied in any color desired.

The resultant synthetic stucco provides a highly effective barrier against water infiltration and is tough and durable to significantly improve abrasion and impact resistance. The addition of latex also results in a mixture that remains flexible when cured and thus further enhances its impact resistance as well as renders it highly resistant to cracks and repeated freeze/thaw cycles. The synthetic stucco layer is also unaffected by most chemicals, including salts, oils and solvents. In addition, the tough and flexible stucco layer is virtually impenetrable to insects and turns it into an unexpected but very effective barrier against termites. Furthermore, cementitious fiber wallboards of the type described offer excellent bonding characteristics for selected resinous latex based compounds and the preferred synthetic stucco mixture, as described in the disclosure, forms an excellent bond directly with the wall panels 10 and the joint sealing tape 18.

All ingredients of acrylic or other selected latex emulsions are commercially available. The preferred embodiment of the latex emulsion includes Rohm and Haas MC-76 water base latex, calcium carbonate sand from Specialty Minerals Inc., Eastman Chemical Texanol coalescing agent, Rhone-Polenc Colloid 610 surfactant, Rhone-Polenc Colloid 226 dispersant, Rhone-Polenc Colloid 643 defoamer, Henkel Nopcocide-96 mildicide, and Huls America Nuo-sept 95 bacticide.

The next step consists of cleaning the surface of the coating 11 on the panels 10 with a water-dampened sponge to leave them slightly damp. It is critical that the surfaces be free of grease, oil, paint, dirt, dust, sealers and any other foreign substances that may prevent proper bonding of the synthetic stucco mixture 20. The synthetic stucco mixture 20 may next be applied to the coated panels 10 while they are still slightly damp to gain the benefit of the water on the coating 11 enhancing the bond formed through such coating between the synthetic stucco mix and the cementitious fiber panels.

Figure 6:
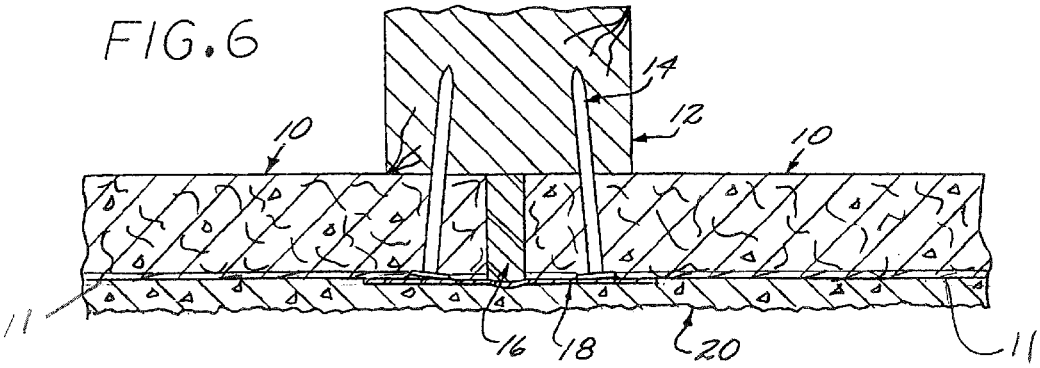
FIG. 6 is a cross sectional view in enlarged scale taken along line 6—6 of FIG. 2.

Referring now to FIG. 6, the synthetic stucco mixture 20 is applied in a single coat and thereby eliminates the time and labor necessary for applying multiple coats. The synthetic stucco mixture 20 can be applied by trowel or with a sprayer to a conventional thickness. The final finish may be textured as desired.

From the foregoing, it will be appreciated that the present invention offers a profound advantage over conventional stucco finishes. In many instances, it eliminates the need for shear panels and the need for multiple coats of material. All this serves to minimize both material and labor by eliminating the need for bond or primer coats. The present invention teaches control of the rate of moisture absorption from synthetic stucco during the curing process to significantly enhance the quality of the finished product and thereby offering substantial savings over the prior art both in the near term and over the life of the structure thus covered. The invention relies on commercially available materials that are easy and environmentally safe to use and apply. The synthetic stucco finish produced by the method of the present invention is weather, pest and shock resistant and cures with a uniform outward appearance that does not deteriorate with time. The present invention therefore effectively and significantly advances the state of the art of residential and commercial construction by successfully addressing a number of long recognized but heretofore unsolved problems.

While a particular embodiment of the invention has been illustrated and described, various modifications can be made without departing from the spirit and scope of the invention and all such modifications and equivalents are intended to be covered.

What is claimed is:

1. A method of making an exterior synthetic stucco exterior wall on a building frame including:

selecting a plurality of commercial grade fiber cement wallboard panels;

selecting joint tape;

selecting a liquid resin based acrylic coating material;

covering the respective one sides of the panels with said coating material to provide uniform coatings on the respective said panels;

positioning said panels on said frame in edgewise relationship with the respective one sides facing outwardly to the exterior and the space between the edges of adjacent panels forming respective gaps;

caulking said gaps;

applying said tape over said caulking in said gaps;

selecting a synthetic stucco mixture of the type which will, when applied to said coatings and said tape, cooperate with said coatings and tape to exhibit a uniform outward coloration and texture; and applying said synthetic stucco mixture to said coatings and said tape.

2. The method as set forth in claim 1 wherein:

said step of applying said coating material includes applying one gallon of said sealer to 400 square feet of said the respective on sides of panels.

3. The method as set forth in claim 1 wherein:

said step of applying said coating material includes applying one gallon of diluted coating material to between 200 and 400 square feet of said panels.

4. The method as set forth in claim 1 wherein:

said coating material is selected as Acrathane sealer and includes the step of diluting said sealer with water.

5. A method as set forth in claim 1, wherein:

said selection of said tape includes selecting a tape having a total thickness of between 10 and 26 mils.

6. A method as set forth in claim 1, wherein:

said selection of said tape includes selecting a tape constructed of a synthetic rubber adhesive on a fabric backing.

7. A method as set forth in claim 1, wherein:

the selection of said panels includes selecting panels constructed of cement, sand and organic fibers covered by a coating of acrylic sealer diluted with one part water.

8. A method as set forth in claim 1, wherein:

said selection of said caulking compound includes selecting a polyurethane caulking compound.

9. A method as set forth in claim 1 wherein:

said stucco mix is selected as including inert sand, water based resinous latex, coalescing agents, dispersants, defoamners and surfactants.

10. A method as set forth in claim 1 wherein:

said selection of said synthetic stucco mixture includes selecting a synthetic stucco mixture manufactured with bacticide and mildicide agents.

11. A method as set forth in claim 1 wherein:

said selection of said synthetic stucco mixture includes selecting a synthetic stucco mixture manufactured with sand.

12. A method as set forth in claim 1 wherein:

said selection of said synthetic stucco mixture includes selecting a synthetic stucco mixture manufactured with calcium carbonate sand.

13. An exterior synthetic stucco wall construction comprising:

vertical frame pieces defining a building frame;

commercial grade fiber cement panels mounted on said frame pieces with their respective one sides facing outwardly and adjacent panels being spaced from one another to form respective narrow gaps therebetween;

water based acrylic sealer applied substantially uniformly to the respective exterior surfaces to form respective coatings;

caulking compound in said gaps;

fabric backed sealing joint tape strips covering said caulking compound in said gaps;and a synthetic stucco layer applied over said coatings and said tape strips to cooperate with said coatings and strips to, upon curing, present a substantially uniform exterior appearance.

14. A wall as set forth in claim 13, wherein:

said tape has a total thickness of less than 27 mils.

15. A wall as set forth in claim 13, wherein:

said tape is constructed of adhesive synthetic rubber with a fabric backing.

16. A wall as set forth in claim 15, wherein:

said adhesive synthetic rubber is an elastomeric modified butyl rubber.

* * * * *